US006863310B1

(12) United States Patent
Petkovsek

(10) Patent No.: US 6,863,310 B1
(45) Date of Patent: Mar. 8, 2005

(54) SPECIAL SERVICE MAILING ASSEMBLY WITH LABEL, TRACKING AREA AND RECEIPT AND A METHOD FOR PREPARING A MAILPIECE FOR DELIVERY

(76) Inventor: Glenn Petkovsek, 2 Saverne Cir., Little Rock, AR (US) 72223

( * ) Notice: Subject to any disclaimer, the term of this patent is extended or adjusted under 35 U.S.C. 154(b) by 0 days.

(21) Appl. No.: 09/487,696

(22) Filed: Jan. 19, 2000

Related U.S. Application Data

(63) Continuation-in-part of application No. 09/286,819, filed on Apr. 6, 1999, now Pat. No. 6,203,068, which is a continuation-in-part of application No. 08/878,046, filed on Jun. 18, 1997, now Pat. No. 5,915,730.

(51) Int. Cl.[7] ..... B42D 15/00

(52) U.S. Cl. ..... 283/79; 283/30; 283/55; 283/60.1; 283/66.1; 283/66.2; 283/81; 283/101; 283/103; 283/104; 283/105; 283/109; 283/116; 40/312; 40/630; 40/654.01; 40/775; 40/776; 229/71; 229/74; 229/92.1; 229/92.8; 229/300; 229/301; 206/232; 206/459.5; 206/460

(58) Field of Search ..... 283/30, 55, 60.1, 283/66.1, 66.2, 79, 81, 101, 103, 104, 105, 109, 116; 40/312, 630, 654.01, 775, 776; 229/71, 74, 92.1, 92.8, 300, 301; 206/232, 460, 459.5

(56) References Cited

U.S. PATENT DOCUMENTS

| | | | | | |
|---|---|---|---|---|---|
| 4,418,865 | A | | 12/1983 | Bowen | |
| 4,492,334 | A | | 1/1985 | Dicker | |
| 4,565,317 | A | | 1/1986 | Kranz | |
| 4,570,416 | A | * | 2/1986 | Shoenfeld | 229/71 |
| 4,632,427 | A | * | 12/1986 | Angus | 229/71 |
| 4,682,793 | A | | 7/1987 | Walz | |
| 4,779,792 | A | * | 10/1988 | Lombardo | 229/71 |
| 4,898,322 | A | * | 2/1990 | Coffey et al. | 229/92.1 |
| 4,927,072 | A | * | 5/1990 | Jenkins et al. | 229/92.1 |
| 5,125,562 | A | * | 6/1992 | Bendel | 229/71 |
| 5,183,203 | A | | 2/1993 | Sanders | |
| 5,190,210 | A | | 3/1993 | Walz | |
| 5,348,780 | A | | 9/1994 | Boggs et al. | |
| 5,476,420 | A | | 12/1995 | Manning | |
| 5,501,393 | A | * | 3/1996 | Walz | 229/29.8 |
| 5,507,526 | A | | 4/1996 | Petkovsek | |
| 5,624,069 | A | * | 4/1997 | Coats et al. | 229/74 |
| 5,626,286 | A | * | 5/1997 | Petkovsek | 229/92.8 |
| 5,626,370 | A | * | 5/1997 | Petkovsek | 283/117 |
| 5,752,647 | A | | 5/1998 | Schubert et al. | |
| 5,862,978 | A | | 1/1999 | Forrest | |
| 5,890,647 | A | * | 4/1999 | Petkovsek | 229/92.8 |
| 5,915,730 | A | | 6/1999 | Petkovsek | |
| 5,918,802 | A | * | 7/1999 | Petkovsek | 229/300 |
| 6,041,999 | A | * | 3/2000 | Petkovsek | 229/92.8 |
| 6,136,129 | A | * | 10/2000 | Petkovsek | 156/247 |
| 6,241,844 | B1 | * | 6/2001 | Petkovsek | 283/61 |
| 2001/0012123 | A1 | * | 8/2001 | Petkovsek | 358/1.17 |

* cited by examiner

*Primary Examiner*—A. L. Wellington
*Assistant Examiner*—Mark Henderson
(74) *Attorney, Agent, or Firm*—Patents & TMS, P.C.

(57) ABSTRACT

A mailing assembly for use in connection with non-domestic delivery of a mailpiece wherein the sender of the mailpiece is required to complete a sender's declaration. The assembly includes a mailing form that may be sub-divided into customs declarations forms, a dispatch notice and a backing sheet. The backing sheet may be peeled off the mailing form exposing adhesive on the backing sheet. The backing sheet may be folded in such a way as to provide an envelope to adhere to the mailpiece to be non-domestically delivered. The customs declarations forms and, dispatch notice may then be inserted into the envelope whereupon the mailpiece may be non-domestically delivered. The customs declaration forms and dispatch notice of the mailing form may be variably printed with information to aid in the non-domestic delivery of the mailpiece.

18 Claims, 12 Drawing Sheets

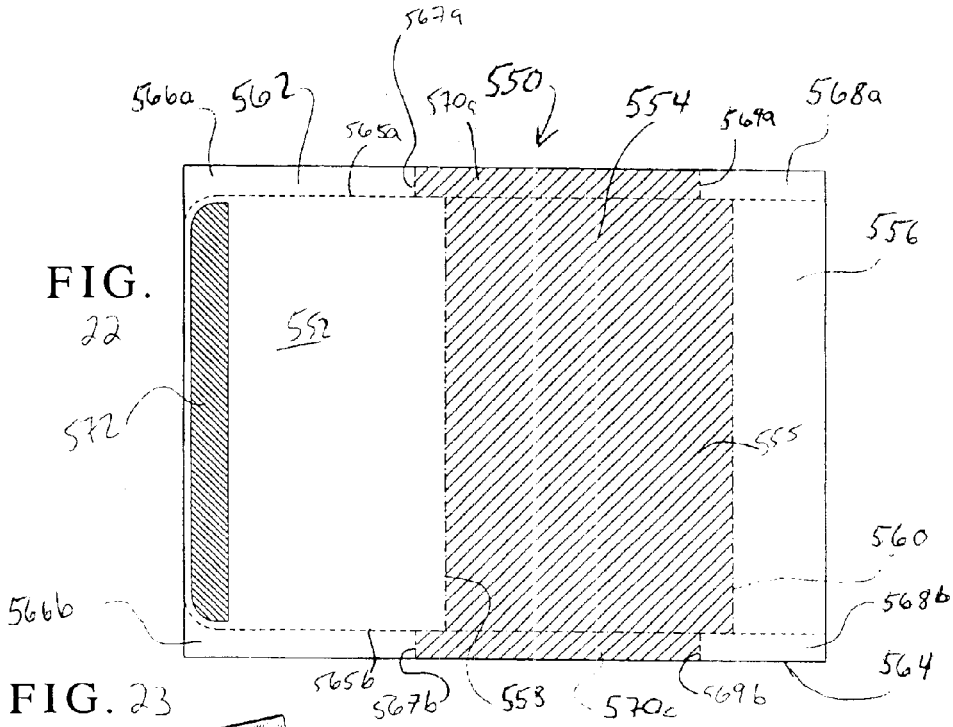
FIG. 22
FIG. 23
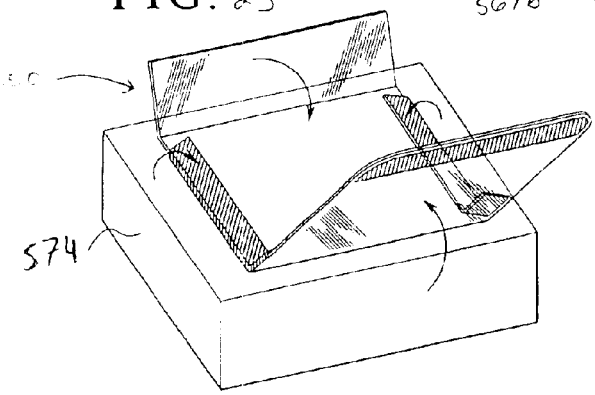
FIG. 25
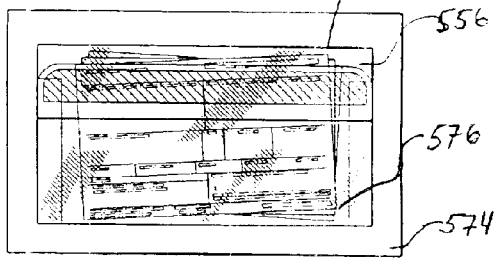
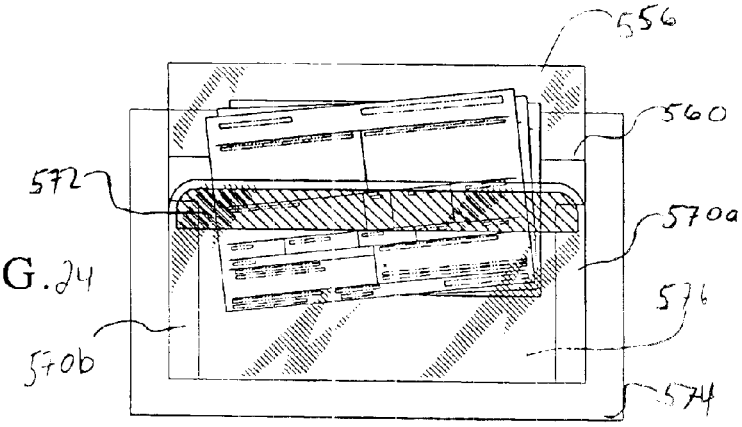
FIG. 24

SPECIAL SERVICE MAILING ASSEMBLY WITH LABEL, TRACKING AREA AND RECEIPT AND A METHOD FOR PREPARING A MAILPIECE FOR DELIVERY

This application is a continuation-in-part of U.S. Ser. No. 09/286,819 filed Apr. 6, 1999, now U.S. Pat. No. 6,203,068 which is a continuation-in-part of U.S. patent application Ser. No. 08/878,046, filed Jun. 18, 1997, now U.S. Pat. No. 5,915,730.

BACKGROUND OF THE INVENTION

The present invention generally relates to a form for printing information relating to mail handling for attachment to a mailpiece. More specifically, the present invention relates to a multi-part form including a multi-part mailing label, a mailing envelope, a tracking area and a detachable receipt card for non-domestic delivery of a mailpiece.

Further, the present invention relates to a multi-part form for non-domestic delivery of a mailpiece including detachable envelopes to secure the parts of multi-part forms therein.

It is, of course, known to provide specialized postal processing and handling of particular mailpieces requiring delivery via Foreign Airmail. Such special services include the preparation of specialized customs/postal forms which certify that the sender of the mailpiece is complying with U.S. Customs requirements with regard to the mailing of the mailpiece.

Traditionally, PS Form 2976 has been used on those packages for Foreign Airmail which are substantially flat (i.e., envelopes and folders). Conversely, PS Form 2976-A has been used for larger, box-type packages. PS Form 2976 is a simple label which may be affixed directly to the outside of the appropriate mailpiece. On this form, the sender of the mailpiece must indicate the weight, value and description of the contents of the mailpiece. PS Form 2976, does not, however, require either a sender's signature or sender's declaration attesting to the contents of the mailpiece. Should the envelope or folder which is being mailed contain any merchandise or merchandise samples, the sender may be required to complete a separate Parcel Post Customs Declaration Form 2996-A which is then retained by the U.S. Postal Service.

PS Form 2976-A is a quadruplicate mailing form which incorporates a customs declaration. This form also requires that a signature be received from the addressee upon delivery of the mailpiece. Once imprinted with the necessary information, PS Form 2976-A is inserted into a see-through mailing envelope which is, in turn, affixed to the mailpiece for delivery.

However, due to recent changes in U.S. Postal regulations, if a package weighing 16 ounces or greater is to be sent via Foreign Airmail, the sender of the package must complete a sender's declaration. Accordingly, many envelopes an folders which previously only required the affixation of PS Form 2976 now also require that a separate Form 2966-A be completed (Customs Declaration).

Given the tremendous increase in the number of Foreign Airmail packages which now require the completion of both a mailing label and a Customs Declaration, there is an increased need for an improved multi-purpose Foreign Airmail mailing form which includes both a mailing label and a sender's declaration and which can be prepared in the most efficient way possible.

SUMMARY OF THE INVENTION

The present invention provides a mailing form for the non-domestic delivery of a mailpiece, particularly envelopes and folders, wherein the form includes both a dispatch notice and custom declarations forms. In addition, the present invention provides a method for preparing a mailpiece for non-domestic delivery wherein a see-through envelope is affixed to the mailpiece and the corresponding customs forms and dispatch notice are contained therein for how domestic delivery of the mailpiece by the special service.

To this end, in an embodiment of the present invention, a mailing assembly is provided for use in connection with a non-domestic delivery of a mailpiece holding contents for delivery thereof. The assembly has a backing sheet wherein the backing sheet is capable of forming a compartment to be adhered to a mailpiece. A mailing form is removably attached to the backing sheet, and the form is variably printed with information necessary to comply with requirements for delivery of the mailpiece wherein the mailing form is capable of fitting within the compartment to effect non-domestic delivery of the mailpiece.

In an embodiment, an adhesive layer is provided on the backing sheet.

In an embodiment, the adhesive layer is between the mailing form and the backing sheet.

In an embodiment, the envelope formed from the backing sheet is capable of adhering to the mailpiece via the adhesive.

In an embodiment, the envelope formed from the backing sheet is capable of being formed via the adhesive layer.

In an embodiment, the envelope formed from the backing sheet is see-through.

In an embodiment, an opening is provided in the compartment wherein the mailing form is capable of entering therethrough.

In an embodiment, a third layer is disposed on the backing sheet having an auxiliary label layer. The auxiliary label has an adhesive thereon.

In another embodiment of the present invention, a mailing assembly is provided for use in connection with non-domestic delivery of a mailpiece. The assembly has a backing sheet wherein the backing sheet is capable of forming an envelope to be adhered to the mailpiece. A mailing form is removably attached to the backing sheet wherein the mailing form is subdivided into a plurality of sub-parts wherein each sub-part is variably printed with information necessary to comply with requirements for non-domestic delivery of the mailpiece.

In an embodiment, an adhesive layer is disposed on the backing sheet.

In an embodiment, the envelope formed from the backing sheet is adhered to the mailpiece via the adhesive layer.

In an embodiment, the envelope formed from the backing sheet is formed via the adhesive layer on the backing sheet.

In an embodiment, a sub-part corresponds to a customs dispatch notice.

In an embodiment, tear lines in the mailing form are disposed between the sub-parts.

In an embodiment, an adhesive capable of affixing a subpart to the backing sheet is provided.

In an embodiment, an envelope formed from the backing sheet is see-through.

In an other embodiment of the present invention, a method for preparing a mailpiece for non-domestic delivery of the mailpiece is provided wherein the mailpiece has contents for delivery thereof. The method comprises the steps of: providing a backing sheet wherein the backing sheet is capable of forming an envelope; providing a mailing form removably attached to the backing sheet wherein the mailing form is sub-divided into a plurality of sub-parts; variably printing information on the mailing form wherein the information is related to non-domestic delivery of the mailpiece; and removing the backing sheet from the mailing form.

In an embodiment, the mailing form is subdivided into the plurality of sub-parts.

In an embodiment, an envelope is formed with the backing sheet and the envelope is adhered to a mailpiece.

In an embodiment, the mailing form is inserted into the envelope that is adhered to the mailpiece.

In an embodiment, the plurality of sub-parts is inserted into the envelope.

It is, therefore, an advantage of the present invention to provide an improved mailing assembly for use in connection with the non-domestic delivery of a mailpiece.

Another advantage of the present invention is to provide an assembly and a method for use in connection with the non-domestic delivery of a mailpiece without requiring additional adhesives or fixatives for attaching the same to a mailpiece.

Yet another advantage of the present invention is to provide an assembly which includes both a mailing label and a sender's declaration which may be used in connection with the non-domestic delivery of a mailpiece; particularly, envelopes and folders.

Moreover, an advantage of the present invention is to provide a mailing assembly for use in connection with the non-domestic delivery of a mailpiece which may be thermally imprinted with information.

Another advantage of the present invention is to provide an assembly and method for use in connection with the non-domestic delivery of a mailpiece which allows the sender to complete but a single form.

A further advantage of the present invention is to provide a simplified assembly and method for use in connections with the non-domestic delivery of a mailpiece.

Additionally, it is an advantage of the present invention to provide an assembly for use in connection with the non-domestic delivery of a mailpiece which is practical and economical.

Another advantage of the present invention is to provide an assembly for use in connection with non-domestic delivery of a mailpiece which includes a peel-off backing sheet which may be constructed into an envelope that may be adhered to the mailpiece.

Moreover, an advantage of the present invention is to provide a mailing assembly for use in connection with the non-domestic delivery of a mailpiece which may be subdivided into a plurality of separate sub-parts.

Additional features and advantages of the present invention are described in, and will be apparent from, the detailed description of the presently preferred embodiments and from the drawings.

BRIEF DESCRIPTION OF THE DRAWINGS

FIG. 22 illustrates a plan view of a front side of a backing sheet in an alternate embodiment of the present invention.

FIG. 23 illustrates a perspective view of a backing sheet adhered to a mailpiece and folded to create an envelope in an alternate embodiment of the present invention.

FIG. 24 illustrates a perspective view of an envelope adhered to a mailpiece and having mailing forms inserted therein in an alternate embodiment of the present invention.

FIG. 25 illustrates a perspective view of an envelope adhered to a mailpiece having mailing forms inserted therein in an alternate embodiment of the present invention.

DETAILED DESCRIPTION OF THE PRESENTLY PREFERRED EMBODIMENTS

Figure 1:
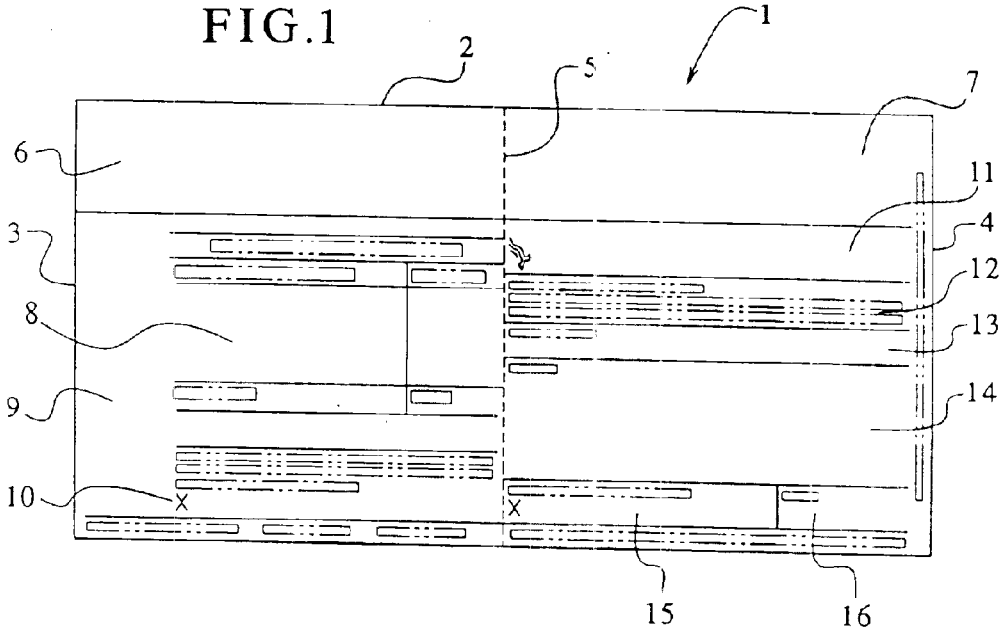
FIG. 1 illustrates a plan view of a front side of an embodiment of the mailing assembly of the present invention.

Referring now to the drawings, wherein like numerals refer to like parts, FIG. 1 is a front-plan view that generally illustrates an embodiment of a mailing assembly 1 formed, in part, from a mailing form 2. The mailing form 2 has a mailing label 3 and a receipt card 4; the mailing label 3 and the receipt card 4 are detachably connected along a mailing form tear line 5.

Among other things, the mailing label 3 includes the type of information traditionally found on PS Form 2976. Indeed, the mailing label 3 includes a mailpiece information area 8 which required the disclosure of the contents of the mailpiece, the weight of the mailpiece and the estimated value of the contents of the mailpiece. In addition, the mailing label 3 includes a label tracking area 9 capable of being variably printed with information necessary to track the associated mailpiece. Furthermore, the mailing label 3 includes a label signature area 10 for receipt of the signature of the sender (or agent) of the mailpiece.

The embodiment shown in FIG. 1 further includes an auxiliary information area 6 on the mailing label 3 which is capable of being imprinted with variable information relating to the non-domestic delivery of the associated mailpiece. For instance, if delivery of the mailpiece is exempt from U.S. Customs' requirements because the mailpiece has a military purpose, the auxiliary information 6 might be imprinted with the words "Contents for Official Use, Exempt from Customs; Requirements-Military Service."

Detachably connected to the mailing label 3 via the mailing form tear line 5 is the receipt card 4. Functionally, the receipt card 4 serves the same purpose as the altogether separate Form 2966-A, Parcel Post Customs Declaration. Thus, the receipt card 4 includes a receipt card tracking area 11 capable of being variably printed with information similar, if not identical, to that which is imprinted in the label tracking area 9 of the mailing label 3.

Also included on the receipt card 4 is a declaration area 12 which is imprinted with a standard declaration statement to which the sender of the mailpiece attests. Sender information area 13 of the receipt card may include the name of the sender of the mailpiece which sender address area 14 may include the address of the sender. Receipt card signature area 15, much like the label signature area 10, may be included for the signature of the sender (or agent) of the mailpiece. At the same time, the sender of the mailpiece enters the appropriate date in a date area 16. The receipt card 4 is preferably provided with a second auxiliary information area 7 intended to be variably imprinted with such optional information as that found, and previously described, in the auxiliary information area 6 of the mailing label 3.

Figure 2:
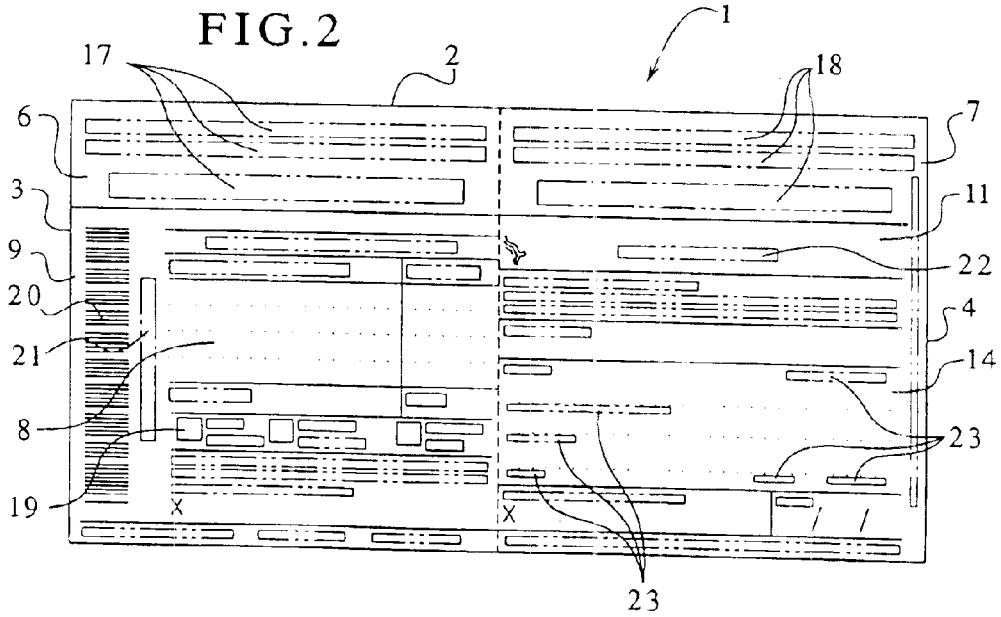
FIG. 2 illustrates a plan view of a front side of an embodiment of the mailing assembly of the present invention having variable information imprinted thereon.

FIG. 2 offers a front view of the embodiment of the mailing assembly 1 from FIG. 1 complete with a variety of variably printed information thereon. Indeed, one of the key advantages of the present invention is that the mailing assembly 1 may be imprinted with such variable information through the use of a thermal printer. Such variable information includes, for example, the auxiliary information 17 within the auxiliary information area 6. Again, the present invention contemplates that a variety of auxiliary information 17 may be imprinted within the auxiliary information area 6 as this is merely an optional informative section, something which is not currently found on PS Form 2976. Additional variably printed information may include a bar code 20 and tracking number 21 placed upon the label tracking area 9. This machine-readable information is intended to be compatible with the United States Postal Service's existing track and trace network. Other variably printed information includes the contents information 19 within the mailpiece information area 8 which includes descriptive boxes by which the sender of the mailpiece may generally identify the contents of the mailpiece.

The receipt card 4 of the mailing form 2 may also be imprinted with variable information. The auxiliary information 18 placed within the second auxiliary information area 7 is intended to be the same as the auxiliary information 17 imprinted upon the mailing label 3. Similarly, a tracking number 22 within the receipt card tracking area 11 may be identical to the tracking number 21 imprinted upon the mailing label 3. Lastly, a variety of specific address queries 23 are preferably imprinted within the center address area 14 for clarity and simplicity.

Figure 3:
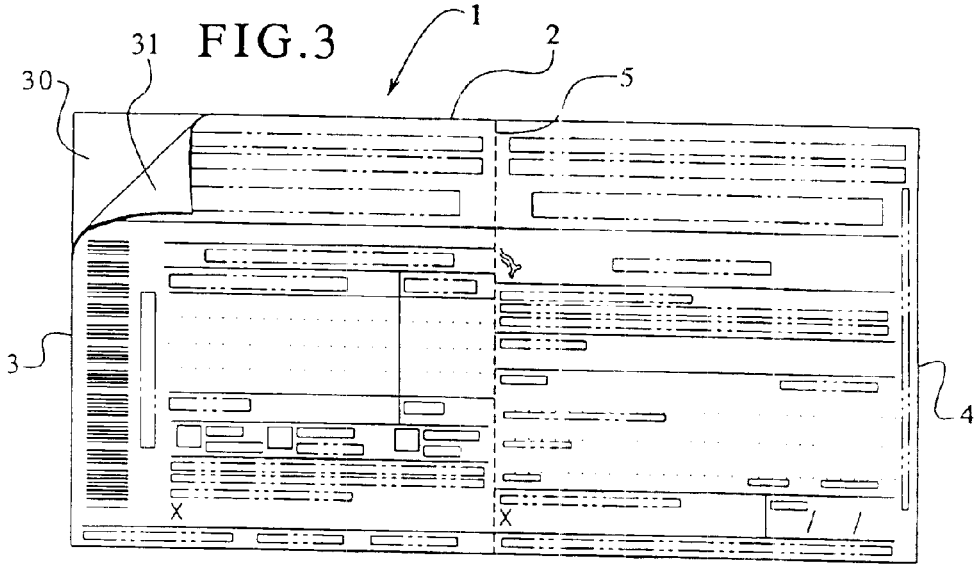
FIG. 3 illustrates a plan view of a front side of an embodiment of the mailing assembly of the present invention with one corner partially peeled away from an associated backing sheet.

Turning now to FIG. 3, the complete mailing assembly 1 from FIG. 2 is shown whereby an upper left-hand corner of the mailing label 3 is partially peeled away from an associated backing sheet 30. Each mailing assembly 1 has a backing sheet 30 which is approximately the same size and shape as the mailing form 2 which is affixed thereupon. Only the mailing label 3 of the mailing form 2, however, is provided with an adhesive layer 31 for detachable adhesion to the backing sheet 30. That is, there is no adhesive layer between the receipt card 4 of the mailing form 2 and the backing sheet 30. Again, the dividing line between the mailing label 3 and the receipt card 4 is defined by the mailing form tear line 5. The adhesive layer 31 serves the dual purpose of initially securing the mailing form 2 to the backing sheet 30 and, after the mailing label 3 is peeled away from the backing sheet 30, of subsequently permanently affixing the mailing label 3 to the desired mailpiece. It should be noted that the receipt card 4 is typically detached from the mailing label 3 prior to the mailing label 3 being permanently affixed to the desired mailpiece.

Indeed, in keeping with current U.S. Postal Customs' requirements, the receipt card 4 may be detached from the mailing label 3 and retained by the U.S. Postal Service immediately after the entire mailing form 2 is filled out by the sender of the mailpiece and presented to a U.S. Postal employee. Thereafter, that mailing label 3 may be peeled away from the backing sheet 30 and immediately placed upon the mailpiece for delivery.

Figure 4:
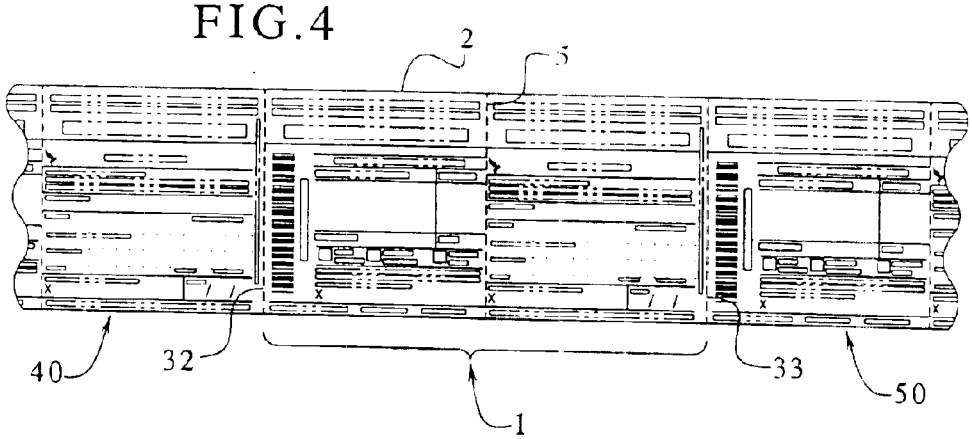
FIG. 4 illustrates a plan view of front sides of a plurality of mailing assemblies of the present invention detachably connected in end-to-end fashion.

FIG. 4 shows another embodiment of the present invention whereby a number of mailing assemblies are continuously and detachably interconnected (end-to-end, for example) such that the mailing assemblies may be provided on a reel or roll. Such reel or roll may be provided for use with, for example, some form of dispensing device. As shown in FIG. 4, the mailing assembly 1 is connected on one of its edges to a second mailing assembly 40 and on the other of its edges to a third mailing assembly 50. The mailing assembly 1 is detachably connected to the second mailing assembly 40 via a first mailing assembly tear line 32 and is detachably connected to the third mailing assembly 50 via a second mailing assembly tear line 33. The mailing assembly tear lines 32 and 44 are perforations which go all the way through to, and may include, the associated backing sheets. Conversely, the mailing form tear line 5 perforates only the mailing form 2 and not the associated backing sheet 30.

Figure 5:
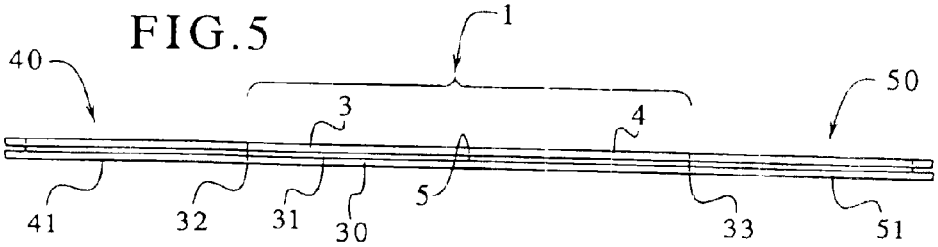
FIG. 5 illustrates a bottom-end view of the embodiments of the mailing assemblies shown in FIG. 4.

Looking now at FIG. 5, a bottom edge of the mailing assemblies from FIG. 4 is shown. Here it may be more clearly observed that the adhesive layer 31 of the mailing assembly 1 is disposed only between the mailing label 3 and the backing sheet 30 and not between the receipt card 4 and the backing sheet 30. Such is the case for all similar mailing assemblies 40, 50, etc. Also, as described in connection with FIG. 4, the first mailing assembly tear line 32 may perforate the entirety of both the mailing assembly 1 and the mailing assembly 40 including their respective backing sheets 30 and 41. Similarly, the second mailing assembly tear line 33 may perforate both the backing sheet 30 and the third backing sheet 51. Conversely, the mailing form tear line of the mailing assembly 1 does not perforate the associated backing sheet 30 but only the associated mailing label 3 and the receipt card 4. Such design ensures that individual mailing assemblies which are provided on a reel or roll may be individually detached from the remaining mailing assemblies with relative ease and without fear of accidental separation of a mailing label from its associated receipt card.

Figure 6:
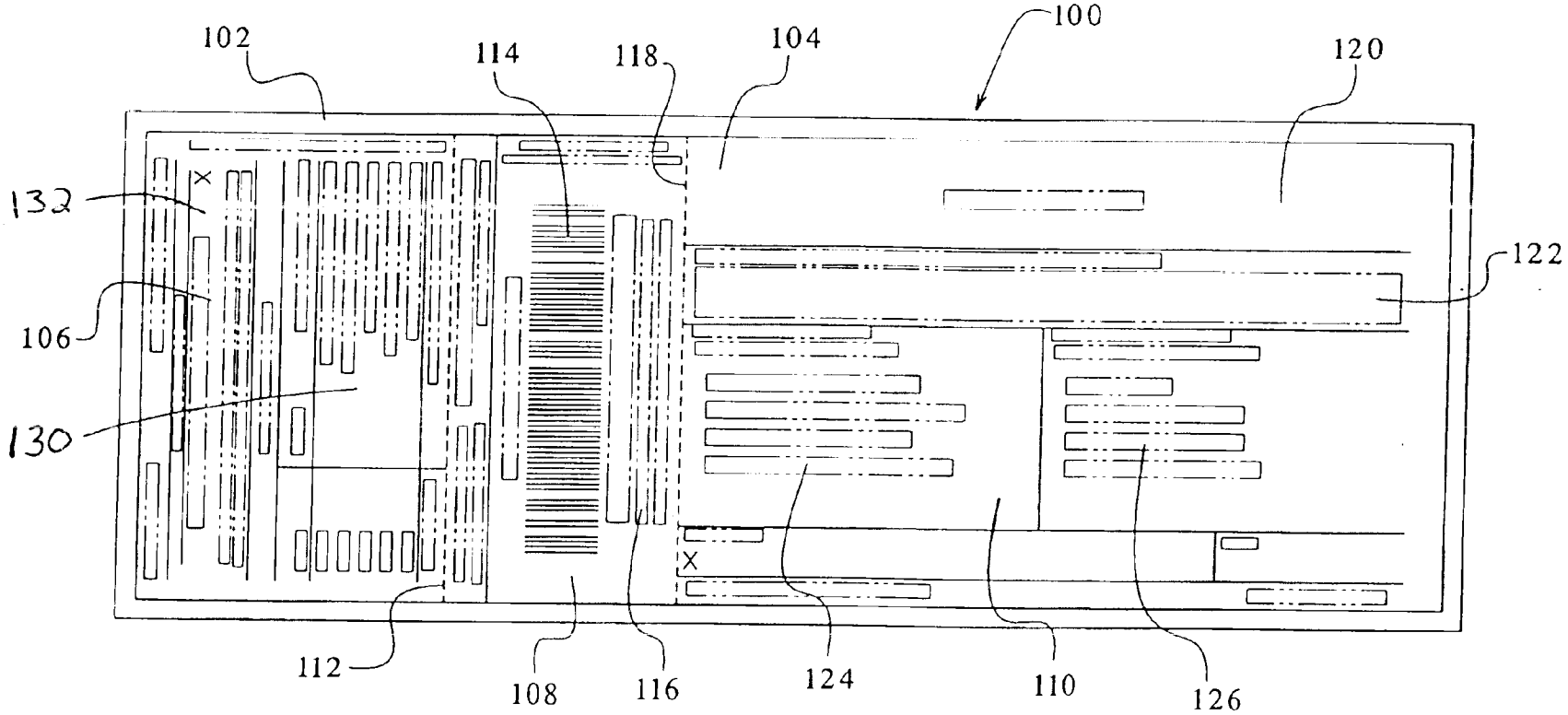
FIG. 6 illustrates a plan view of a front side of an embodiment of the mailing assembly of the present invention.

FIG. 6 illustrates another embodiment of a mailing assembly 100. The mailing assembly 100 includes a backing sheet 102. Further, the mailing assembly 100 includes a mailing form 104 that is removably attached to the backing sheet 102 by an adhesive (not shown in FIG. 6). The adhesive is applied between the mailing form 104 and the backing sheet 102 substantially as shown and described with reference to FIGS. 1–5. The mailing form 104 is separable into three portions: a mailing label 106, a tracking area 108 and a receipt card 110.

The mailing label 106 includes information traditionally found on United States Postal Service Form (PS) 2976. Generally, PS Form 2976 includes an area 130 which requires the disclosure of the contents of the mailpiece, the weight of the mailpiece and the estimated value of the contents of the mailpiece. Furthermore, the mailing label 106 includes a signature area 132 for the signature of the sender or agent of the mailpiece. The mailing label 106 is preferably distinctly colored with a background shade distinct from a remainder of the assembly 100. All of the information may be variably printed on the assembly 100, therefore, the assembly may be provided as a "blank" having no information printed thereon.

Detachably connected to the mailing label 106 via the mailing form tear line 112 is the tracking area 108. The tracking area 108 includes a machine-readable code section 114 capable of being variably printed with machine-readable information associated with the mailpiece. The machine-readable code section 114 aids in tracking the associated mailpiece. Additionally, auxiliary information may be variably printed on the tracking area 108 in an auxiliary information area 116, the auxiliary information relating to the delivery of the associated mailpiece. For example, if delivery of the mailpiece is exempt from U.S. Customs' requirements because the mailpiece has a military purpose, the auxiliary information area 116 may be imprinted with the words "Contents for Official Use, Exempt from Customs' Requirements-Military Service."

Detachably connected to the tracking area 108 via a tear line 118 is the receipt card 110. Functionally, the receipt card 110 serves the same purpose as the altogether separate PS Form 2966-A, Parcel Post Customs' Declaration. The receipt card 110 includes a receipt card tracking area 120 capable of being variably printed with information similar to, if not identical to, that which is imprinted in the tracking area 108.

Also included on the receipt card 110 is a Sender's Declaration area 122 which may be printed with the standard declaration statement to which the sender of the mailpiece attests. Sender information area 124 may include the address of the sender. Additionally, addressee address area 126 may include the address of the addressee.

A preferable embodiment of the present invention includes a backing sheet removably attached by an adhesive to the mailing label 106 and the tracking area 108. The adhesive does not extend to the receipt card 110 (not shown).

Figure 7:
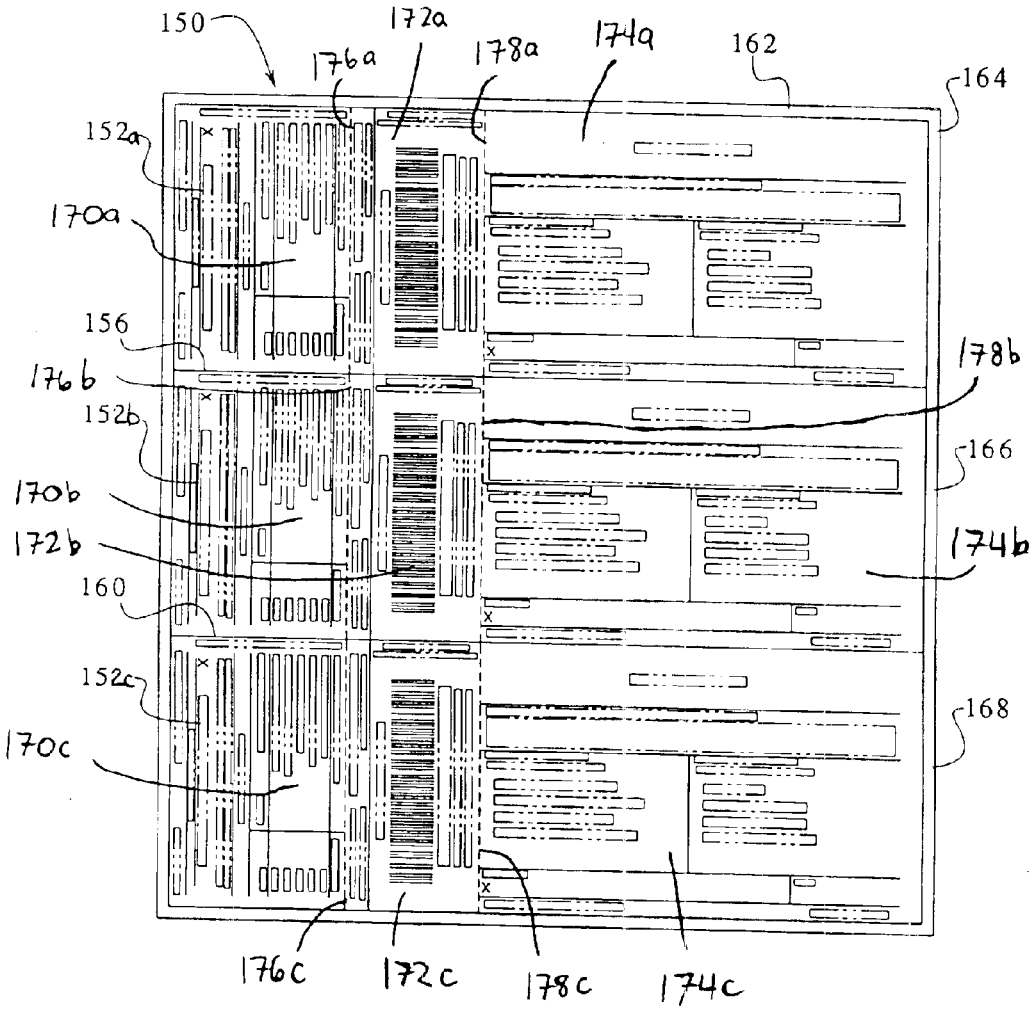
FIG. 7 illustrates a plan view of front sides of three mailing assemblies of the present invention detachably connected.

FIG. 7 illustrates yet another embodiment of the present invention whereby a plurality of mailing assemblies 152*a*, 152*b* and 152*c* are detachably connected such that the mailing assemblies 152*a*, 152*b* and 152*c* may be provided on a single sheet 150. As shown in FIG. 7, the sheet 150 includes a first mailing assembly 152*a* detachably connected along its bottom edge to a second mailing assembly 152*b* via a tear line 156. The mailing assembly 152*b* may be detachably connected along its bottom edge to a third mailing assembly 152*c* via a tear line 160. The sheet 150 may be provided for use with, for example, a printing mechanism to provide printed information. Specifically, the sheet 150 may be fed through a laser printer.

The sheet 150 includes a backing sheet 162 removably attached to the mailing assemblies 152*a*, 152*b* and 152*c* via an adhesive (not shown). The tear lines 156,160 may extend through the backing sheet 162 subdividing backing sheet 162 into three separable backing sheets 164, 166, and 168. Alternatively, the tear lines 156, 160 may extend only through the mailing assemblies 152*a*, 152*b*, and 152*c* leaving the backing sheet 162 intact as a single backing sheet. The mailing assemblies 152*a*, 152*b*, and 152*c* are all similar mailing assemblies to the mailing assembly 104 of FIG. 6. The mailing assemblies 152*a*, 152*b* and 152*c* include tear lines 176*a*, 176*b* and 176*c* separating each of the mailing assemblies 152*a*, 152*b* and 152*c* into three portions: mailing labels 170*a*, 170*b* and 170*c*, tracking areas 172*a*, 172*b* and 172*c*, and receipt cards 174*a*, 174*b* and 174*c*, respectively. The mailing labels 170*a*, 170*b* and 170*c* are separable from the tracking areas 172*a*, 172*b* and 172*c* via tear lines 176*a*, 176*b* and 176*c*, respectively. The tracking areas 172*a*, 172*b* and 172*c* are separable from the receipt cards 174*a*, 174*b* and 174*c* via tear lines 178*a*, 178*b* and 178*c*, respectively.

The mailing labels 170*a*, 170*b* and 170*c* include information traditionally found on PS Form 2976. The mailing labels 170*a*, 170*b* and 170*c* are preferably distinctly colored with a background shade distinct from a remainder of the assemblies 152*a*, 152*b* and 152*c*. All of the information may be variably printed on the mailing assemblies 152*a*, 152*b* and 152*c*; therefore, the mailing assemblies 152*a*, 152*b* and 152*c* may be provided as a "blank" having no information printed thereon.

Figure 9:
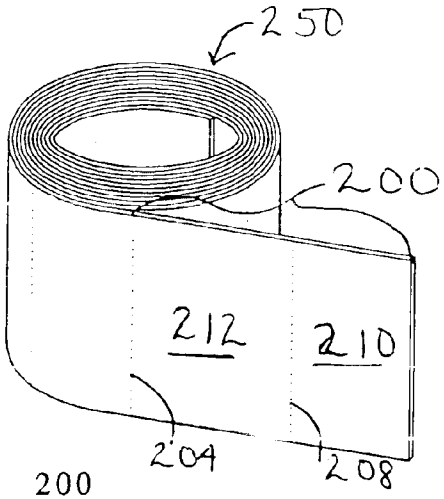
FIG. 9 illustrates a perspective view of a plurality of mailing assemblies of the present invention detachably connected in end-to-end fashion and rolled.
Figure 8:
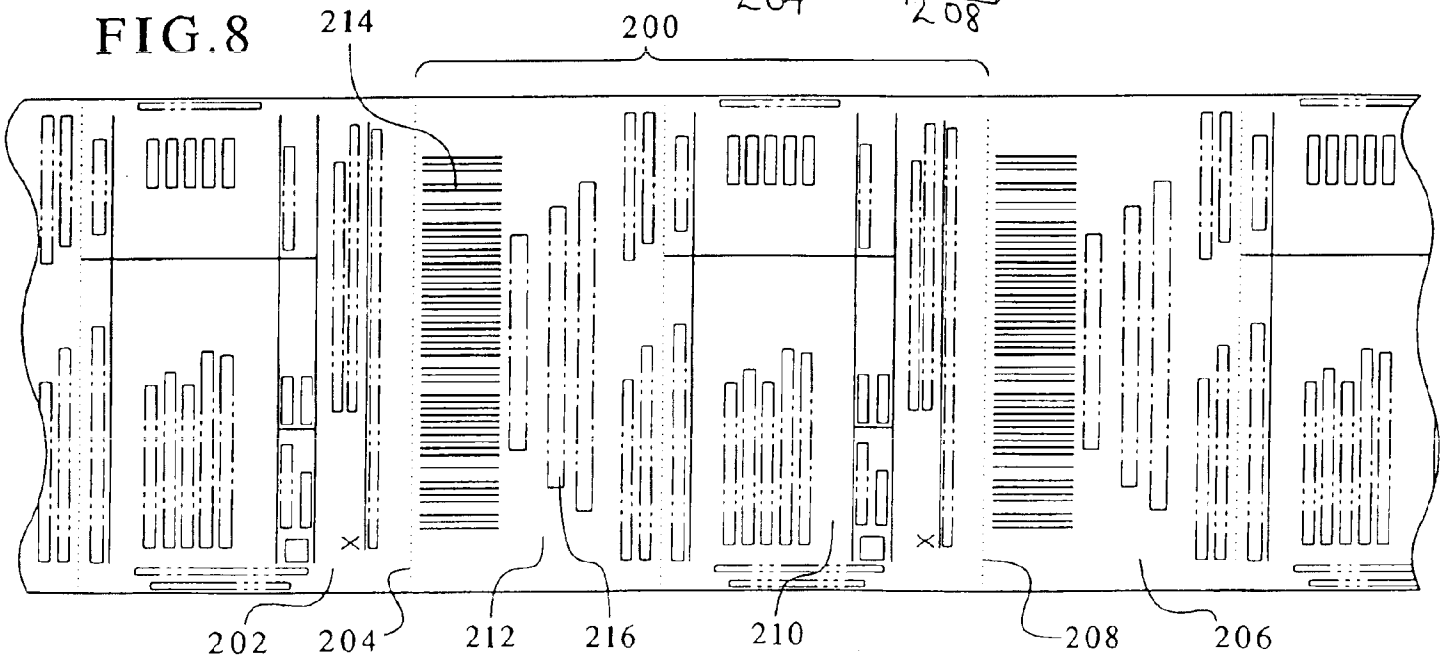
FIG. 8 illustrates a plan view of front sides of a plurality of mailing assemblies of the present invention detachably connected in end-to-end fashion.

FIG. 8 shows another embodiment of the present invention wherein a plurality of mailing assemblies are continuously and detachably interconnected (end-to-end, for example) such that the mailing assemblies may be provided on a reel or roll 250 as shown in FIG. 9. As shown in FIG. 8, a mailing assembly 200 may be detachably connected on a first edge to a second mailing assembly 202 via a tear line 204. The mailing assembly 200 may be further detachably connected on a second edge to a third mailing assembly 206 via tear line 208.

The mailing assembly 200 includes a mailing label 210 which corresponds to PS Form 2976. The mailing label 210 is detachably connected to a tracking area 212. The tracking area 212 includes a machine-readable code section 214 wherein the machine-readable information may be variably printed to correspond to a mailpiece. Further, the tracking area 212 includes an auxiliary information area section 216 which may be variably printed with information relating to the delivery of a mailpiece. The mailing assembly is a simplified mailing assembly to aid in the delivery of a mailpiece where a receipt card is not required or otherwise necessary.

FIG. 9 shows a plurality of mailing assemblies 200 connected in an end-to-end fashion in a reel or roll 250. Each mailing assembly 200 includes a mailing label 210 and a tracking area 212 detachably connected to each other via the tear line 208. Each of the mailing assemblies 200 is detachably connected to another mailing assembly 200 via the tear line 204.

Figure 10:
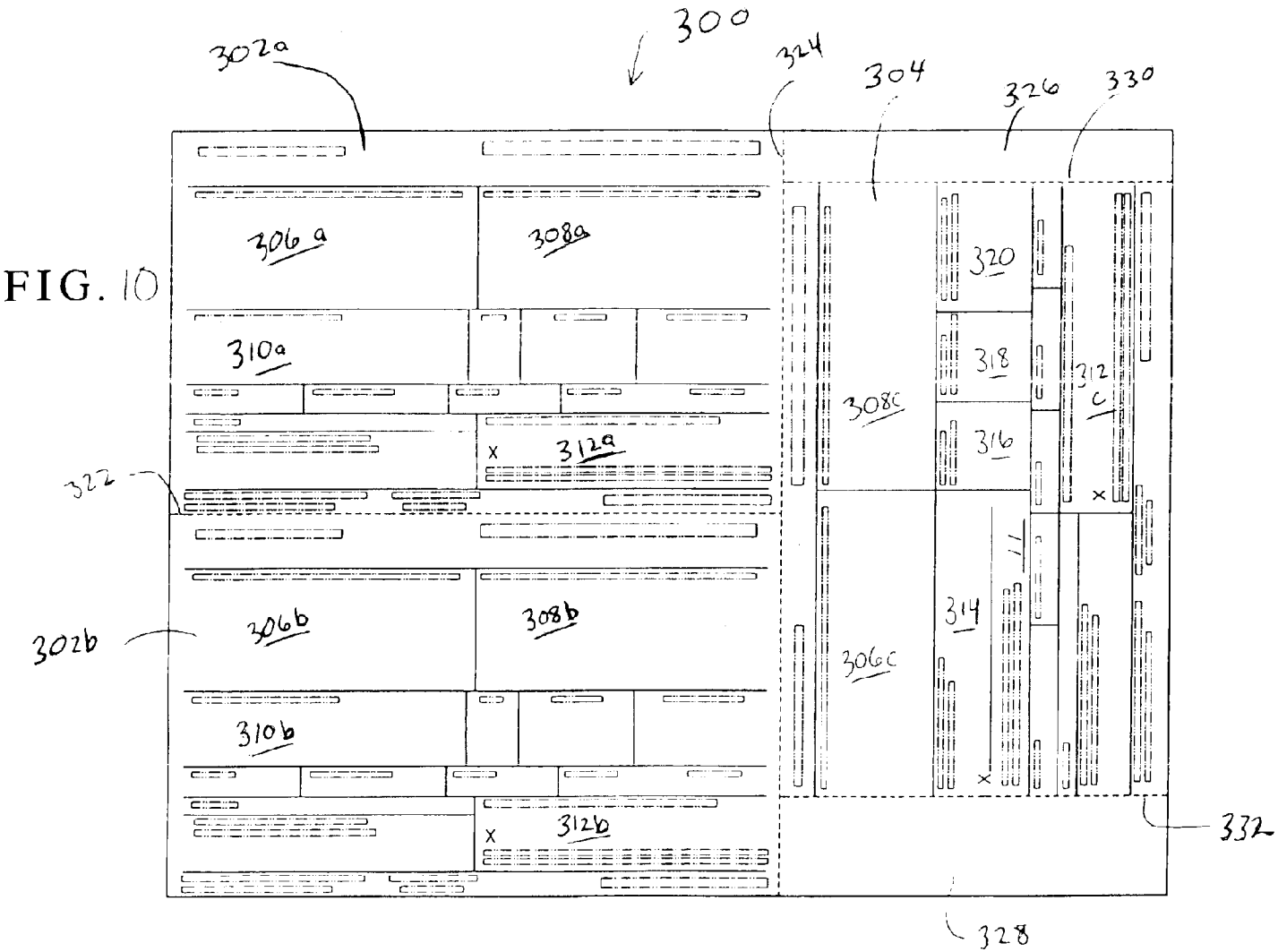
FIG. 10 illustrates a plan view of a mailing form in an embodiment of the mailing assembly of the present invention.

Referring now to FIG. 10, another embodiment of the present invention is shown. A mailing form 300 may have a plurality of sub-parts 302*a*, 302*b*, and 304. Subparts 302*a*, 302*b* may correspond to two identical copies of PS Form 2976-A. Indeed, the two sub-parts 302*a*,302*b* may include a sender's name and address section 306*a*,306*b*, respectively; an addressee's name and address section 308*a*,308*b*, respectively; a list of contents section 310*a*,310*b*, respectively; and a sender's signature and date section 312*a*,312*b*, respectively. These various sections may aid in the delivery of a non-domestic delivery of a mailpiece requiring PS Form 2976-A. Each sub-part 302*a*,302*b* may be removed from an envelope attached to the mailpiece at certain times during the non-domestic delivery as required by regulations concerning the non-domestic delivery of mailpieces.

Sub-part 304 may correspond to a dispatch notice which may also correspond to PS-Form 2976-A. The dispatch notice may also contain a sender's name and address section 306*c*, an addressee's name and address section 308*c*, and a sender's signature and date section 312*c*. However, sub-part 304 may contain sections that differ from the customs declaration forms 302*a*,302*b*. For example, the dispatch notice 304 may contain an addressee's signature and date section 314, a customs duty section 316, a customs stamp section 318 and a mailing office date stamp 320. These sections may aid in the non-domestic delivery of the mailpiece in that they may provide a record for the post office that the mailpiece was delivered and that the addressee signed and dated it as such. The dispatch notice 304 may then be sent back to the sender of the mailpiece to indicate to the sender that the mailpiece was delivered.

The customs declaration forms 302*a*,302*b* may be arranged adjacently as shown in FIG. 10 while the dispatch notice 304 may be removably attached on an end of the mailing form 300. The customs declaration forms 302*a*,302*b* may be removably attached to each other via a tear line 322. Further, the dispatch notice 304 may be removably attached to the customs declaration forms 302*a*,302*b* via a tear line 324.

The mailing form 300 may have a first section 326 and a second section 328 on opposite ends of the dispatch notice 304. The first section 326 may be removably attached to the dispatch notice via the tear line 330 and the second section 328 may be removably attached to the dispatch notice via the tear line 332. The first and second sections 326,328 may fill in space on either side of the dispatch notice 304 and/or may be printed with information to aid a sender in the non-domestic delivery of the mailpiece or other like instructions. The first and second sections 326,328 may be any size without detracting from the nature of the invention. However, with regard to mailing form 300, the arrangement of the dispatch notice 304 on mailing form 300 may be important as discussed hereinafter with respect to FIG. 11.

Figure 11:
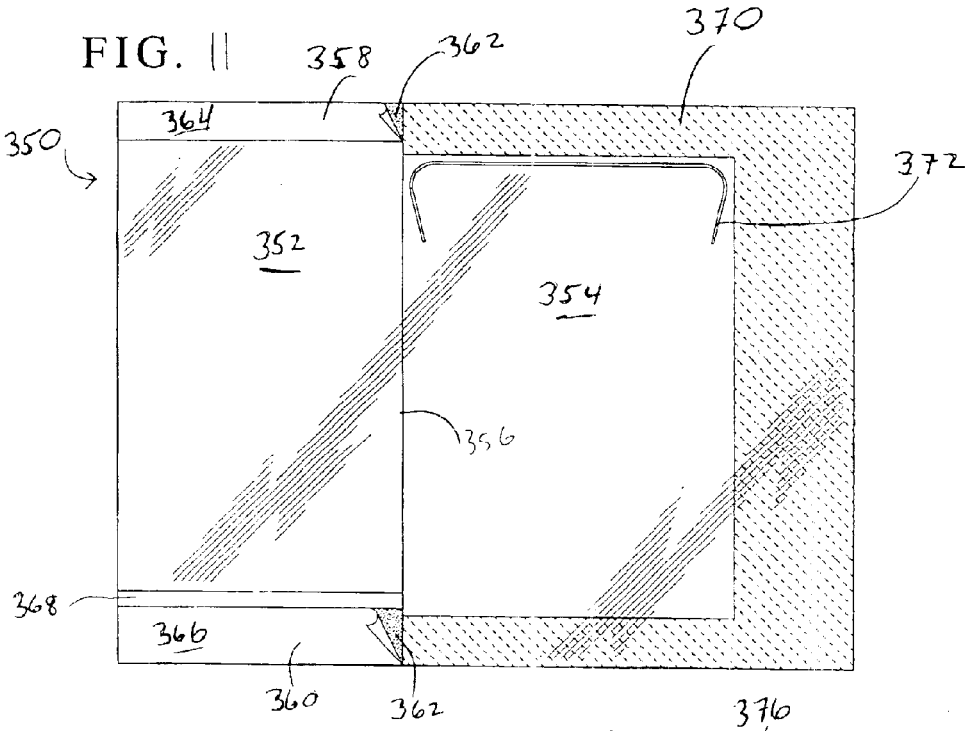
FIG. 11 illustrates a plan view of a bottom side of a backing sheet in an embodiment of the mailing assembly of the present invention.

FIG. 11 shows a plan view of a back side of a backing sheet 350 that may be removably attached to a backside of the mailing form 300. The backing sheet 350 may be constructed of two sections 352,354 separated by a fold line 356. The section 352 may contain two anchor portions 358,360. Each of the anchor portions 358,360 may contain an adhesive layer 362. Disposed on each adhesive layer may be backing strips 364,366 disposed on the adhesive layer 362 on each of the anchor portions 358,360, respectively. An adhesive 368 may be disposed on the front side of the backing sheet 350 and may adhere the dispatch notice 304 to the front side of the backing sheet 350. The adhesive 368 may provide a bond between the dispatch notice 304 and the front side of the backing sheet 350.

The section 354 may contain an adhesive layer 370 disposed on the front side of the backing sheet 350 in contact with a backside of the mailing form 300 to hold the mailing form 300 to the backing sheet 350 prior to separation of the mailing form 300 from the backing-sheet 350. The mailing form 300 may be removable from the backing sheet 350 whereupon the adhesive layer 370 may remain on the backing sheet 350. Disposed in the section 354 is a slit 372 through which the customs declaration forms 302*a*,302*b* and the dispatch notice 304 may be slid.

Figure 12:
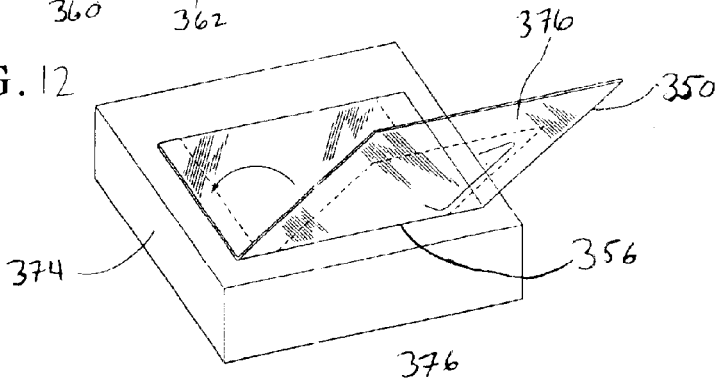
FIG. 12 illustrates a perspective view of a backing sheet folded to create an envelope.
Figure 13:
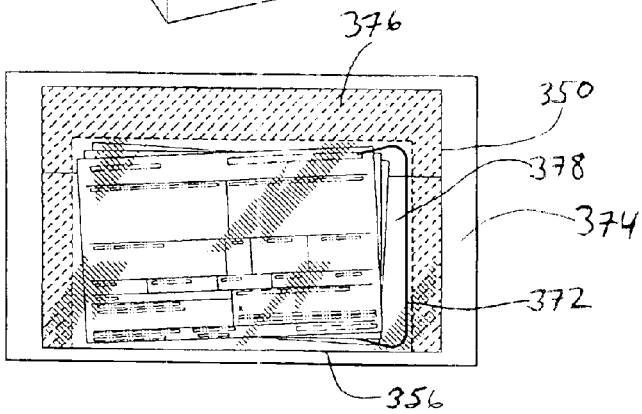
FIG. 13 illustrates a plan view of an envelope folded and adhered to a mailpiece.

FIGS. 12 and 13 show how the backing sheet 350 may be folded to form an envelope that may be attached to a mailpiece 374. The backing sheet 350 may be attached to the mailpiece 374 via the anchor portions 358,360 after the backing strips 364,366 have been removed exposing the adhesive layer 362. After the section 352 is then adhered to the mailpiece 374, the backing sheet 350 may be folded on the fold line 356 to form an envelope. The section 354 folds to overlay with the section 352. A portion of the adhesive layer 370 adheres to the section 352 in order to form a compartment 378 that is sealed on all four sides. A top portion 376 of the section 354 may overlay so that the top portion 376 is disposed directly on the mailpiece 374 further providing an anchor for the envelope on the mailpiece 374. The slit 372 may act as the only entry point to the compartment of the envelope disposed in the mailpiece 374.

When the backing sheet 350 is folded along foldline 356 and the section 354 is folded to overlay the section 352, the dispatch notice 304 may then be contained within the envelope that is formed. Therefore, folding the section 354 will enclose the dispatch notice 304. The customs declarations forms 302*a*,302*b* may be removed from each other and the dispatch notice 304 via the tear lines 322,324. The two customs declaration forms 302*a*,302*b* may be slipped via the slit 372 into the compartment 378 created by folding the section 354 on top of the section 352 whereupon the three forms 302*a*,302*b* and 304 may be sent with the mailpiece 374. The backing sheet 350 may be transparent to allow the forms contained within the compartment 378 to be readily viewed. The entire mailing form 300 and backing sheet 350 may be fed into a printer to be printed with information to aid in the non-domestic delivery of the mailpiece. Printing may be done by laser, ink jet, dot matrix, thermal or any other like printing means. Further, the mailing form 300 may measure 8-½"×11" to aid in printing information on the mailing form 300. However, the mailing form 300 may be any size without detracting from the nature of the present invention.

Figure 14:
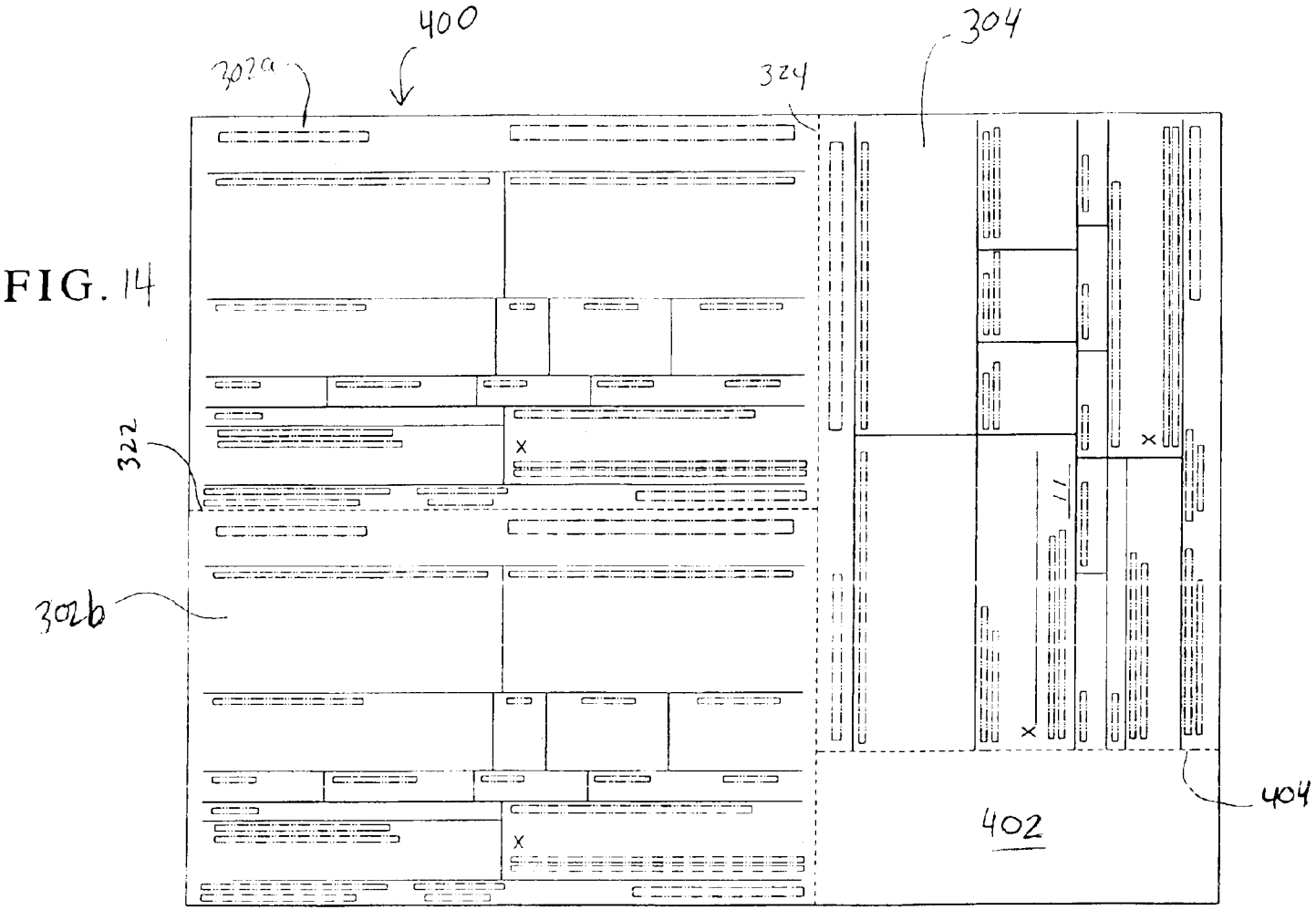
FIG. 14 illustrates a plan view of an alternate of the mailing form of the present invention.

FIG. 14 shows an alternate embodiment of a mailing form 400 including the previously described plurality of sub-parts: the two customs declaration forms 302*a*,302*b* and the dispatch notice 304. The difference between the mailing form 400 and the mailing form 300, as shown in FIG. 10, is that the sub-parts 302*a*,302*b* and 304 may be arranged so that the dispatch notice 304 may be disposed on an edge of the mailing form 400 leaving a relatively large section 402 on the mailing form 400 instead of two smaller sections 326, 328 as shown in FIG. 10. The section 402 may be removable from the mailing form 400 via tear lines 324 and 404. The section 402 may contain information to aid in the delivery of the mailpiece by the special service.

Figure 15:
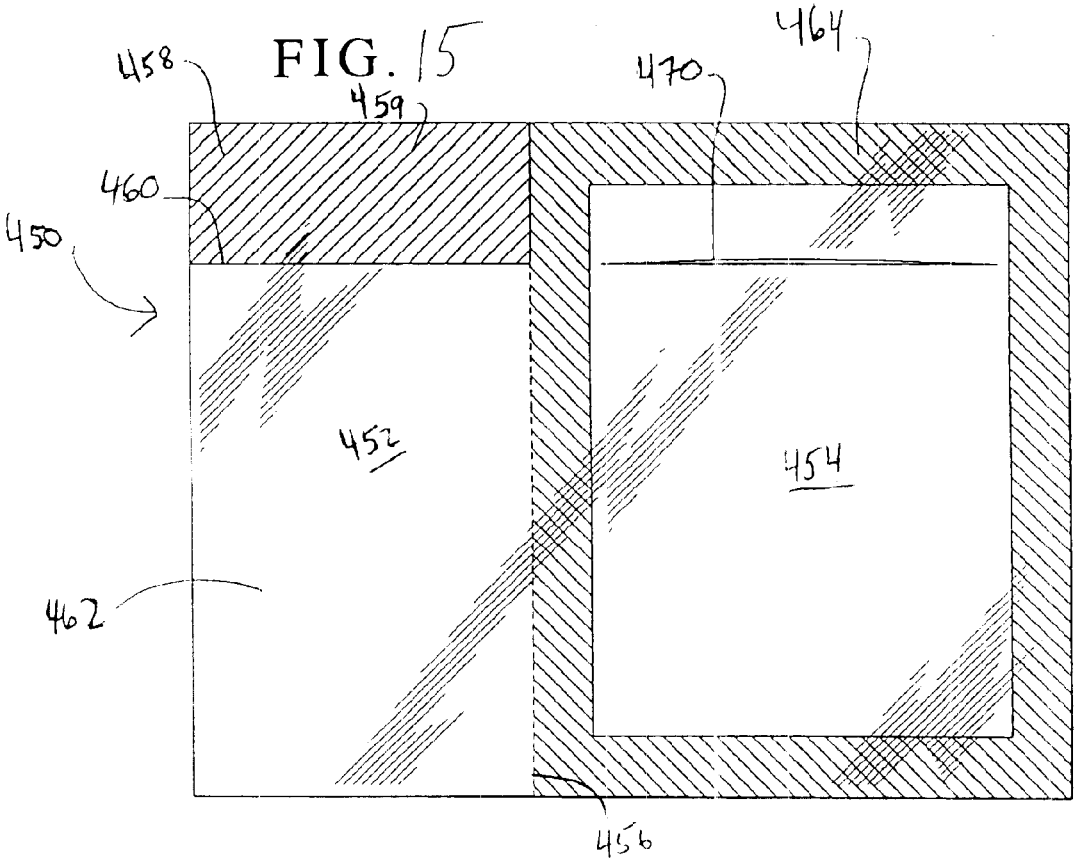
FIG. 15 illustrates a plan view of a front side of a backing sheet in an alternate embodiment of the present invention.

FIG. 15 shows a frontside view of a backing sheet 450 that may be disposed on the backside of the mailing form 400. The backing sheet 450 may have two sections 452,454 that are separable from each other via a tear line 456. The section 452 may have an area 458 of adhesive that may adhere to a backside of the blank section 402 of the mailing form 400. The entire area 458 may remain attached to the blank section 402 and be separated from the backing sheet 450 and the mailing form 400 via the tear lines 456,460, 334 and 404. Generally, the section 402 and area 458 attached to the section 402 via the adhesive 450 may be discarded following their removal. Alternatively, the section 402 may be peeled from the area 458 and used as an auxiliary label. A second area 462 of the backing sheet 450 may be detached from the section 454 and the area 458 via tear lines 456 and 460 and discarded. The dispatch notice 304 and the section 402 may overlay with the second area 462 and the area 458, respectively, of the section 452.

Figure 16:
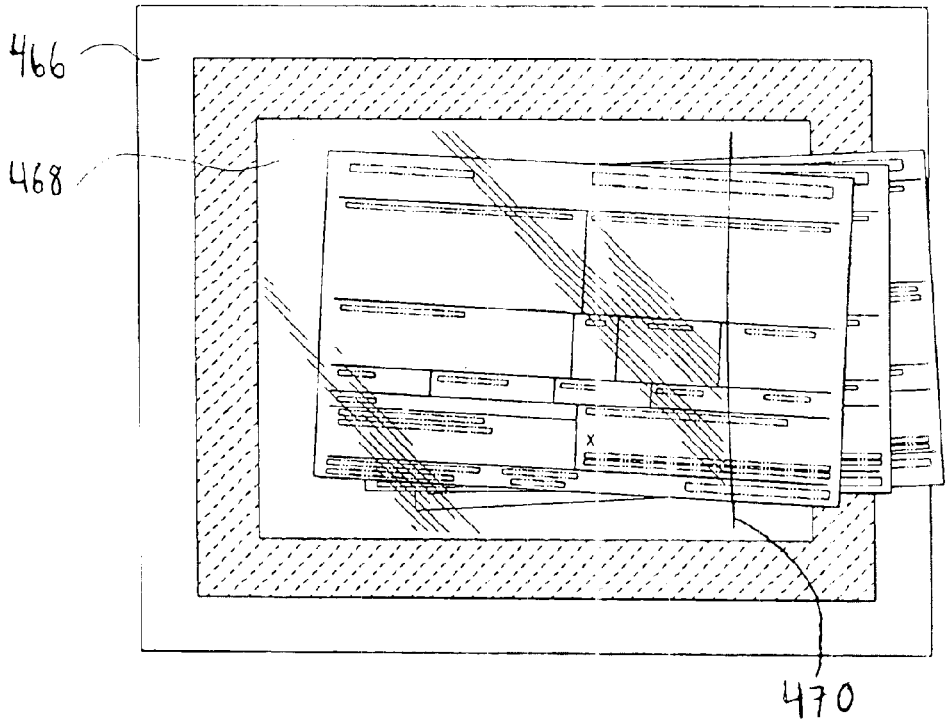
FIG. 16 illustrates a perspective view of an envelope adhered to a mailpiece in an alternate embodiment of the present invention.

The section 454 may contain an adhesive 464 between a portion of the section 454 and the mailing form 400. The adhesive 464 may hold the section 454 to the mailing form 400 until the mailing form 400 is removed from the backing sheet 450. Upon removal of the mailing form 400 from the backing sheet 450, the adhesive 464 may remain with the section 454. The section 454 may be removed from the section 452 via the tear line 456 and attached to a mailpiece 466 as shown in FIG. 16. The adhesive 464 may provide a seal on all four sides of the section 454 when the section 454 is attached to the mailpiece 466 and may form a compartment 468. A slit 470 may be provided in the section 454 to permit entry into the compartment 468. The two customs declarations forms 302*a*,302*b* and the dispatch notice 304 may be slipped inside the compartment 468 through the slit 470 to remain while the mailpiece 466 is non-domestically delivered. The slit 470 also may allow the customs declarations forms 302*a*,302*b* and/or the dispatch notice 304 to be removed from the compartment 468 at various times throughout the delivery of the mailpiece 466, if necessary. The backing sheet 450 may be see-through to provide a visual access to the inside of the compartment 468 through the section 454.

Figure 17:
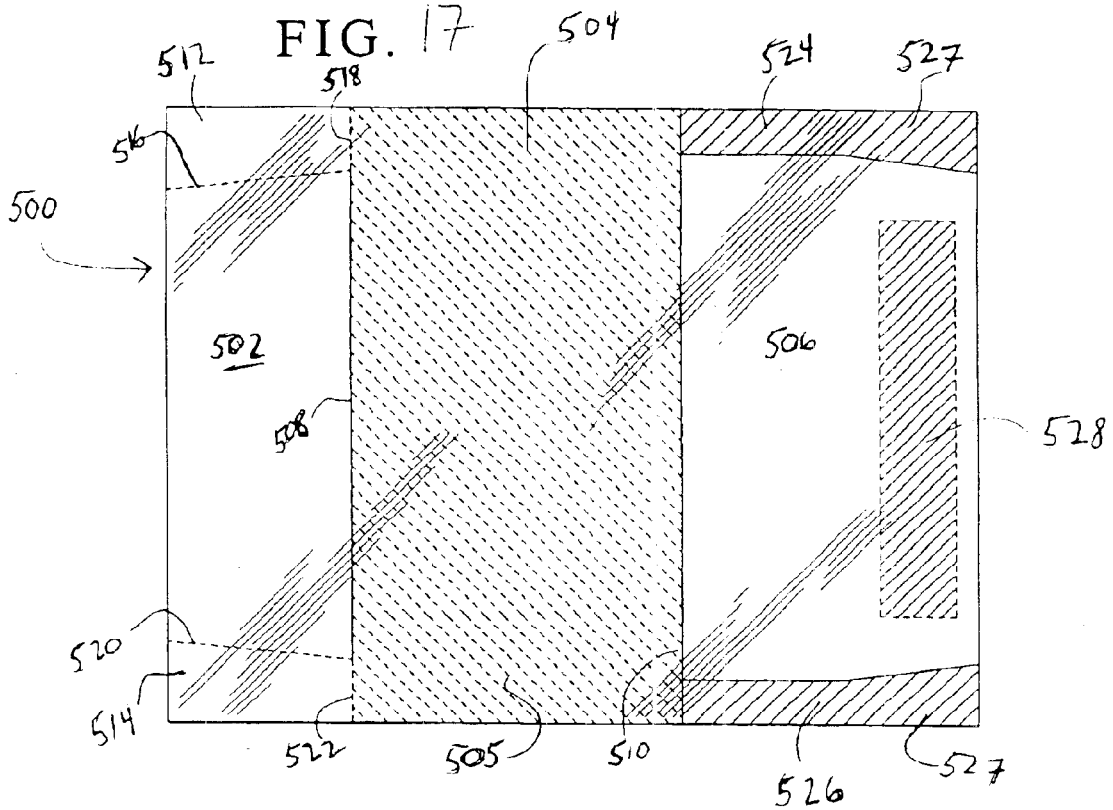
FIG. 17 illustrates a plan view of a front side of a backing sheet in an embodiment of the present invention.

Now referring to FIG. 17, a frontside view of a backing sheet 500 is shown. Of course, the mailing form 300 or the mailing form 400 may be provided and disposed on a frontside of the backing sheet 500. The backing sheet 500 may have three sections 502, 504 and 506 adjacently disposed and separated from one another via fold lines 508,510. The first section 502 may have removable sections 512,514 disposed on opposite ends of the first section 502. The removable sections 512,514 may be removed from a remainder of the first section 502 via tear lines 516,518 with respect to removable section 512 and tear lines 520,522 with respect to removable section 514.

The second section 504 may have an adhesive layer 505 disposed on a backside of the backing sheet 500 that may cover the entire backside of the second section 504, although any like adhesive pattern is contemplated by the present invention. The third section 506 may have anchor portions 524,526 disposed on opposite ends of the third section 506. The anchor portions 524,526 may contain an adhesive that is exposed when a mailing form such as the mailing form 300, as shown in FIG. 10, or the mailing form 400, as shown in FIG. 14, is removed. Further, an adhesive section 528 may be disposed on a backside of the backing sheet 500.

Figure 18:
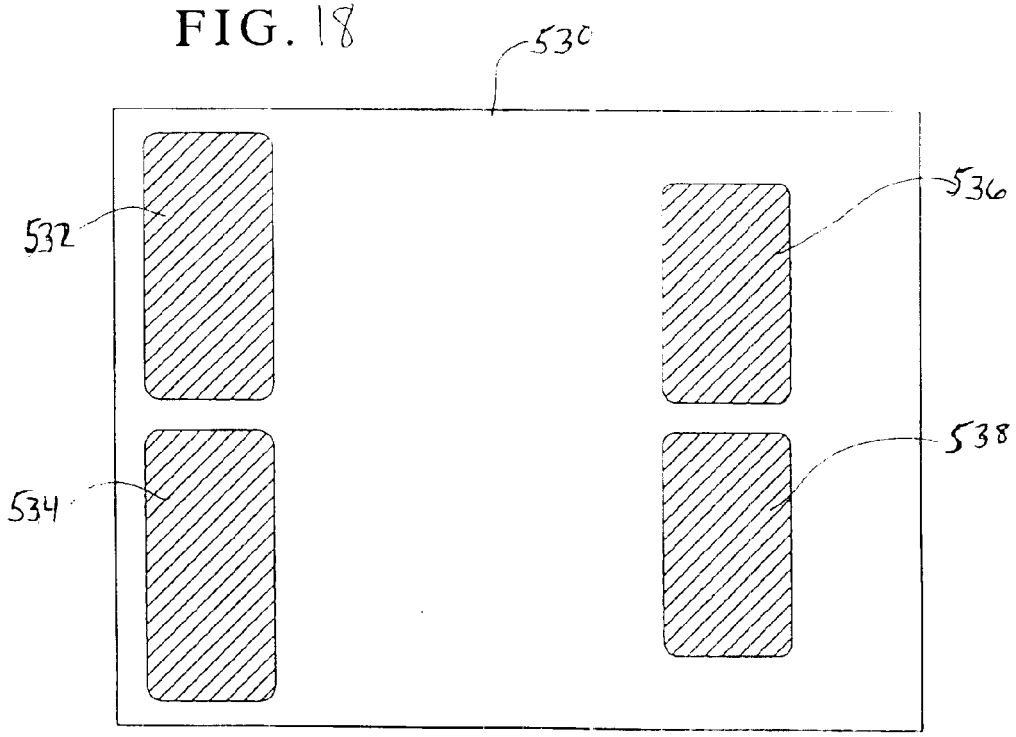
FIG. 18 illustrates a plan view of a front side of a third layer having auxiliary labels in an embodiment of the present invention.

A third layer 530, as shown in FIG. 18, may be disposed on a backside of the backing sheet 500 to provide a backing for the adhesive layer that may be contained on the backside of the backing sheet 500. The third layer 530 may contain a plurality of labels 532, 534, 536 and 538 that may have adhesive disposed thereon. When any of the labels 532, 534, 536 or 538 are peeled from the third layer 530, the adhesive may remain on the label and provide an adherence means for the labels 532, 534, 536 and 538. These labels may be used to aid in the non-domestic delivery of the mailpiece 540 or in any like manner. The labels 532, 534, 536 and 538 may be disposed on the third layer 530 in such positions as to not interfere with adhesive that may be disposed on the backside of the backing sheet 500.

In use, the mailing form 300, 400 or other like mailing form that may be disposed on the front side of the backing sheet 500 may be peeled off and separated to from the two customs declaration forms 302*a*,302*b* and the dispatch notice 304. Of course, the customs declaration forms 302*a*, 302*b* and the dispatch notice 304 may have variable printing thereupon to effect the non-domestic delivery of the mailpiece.

Figure 19:
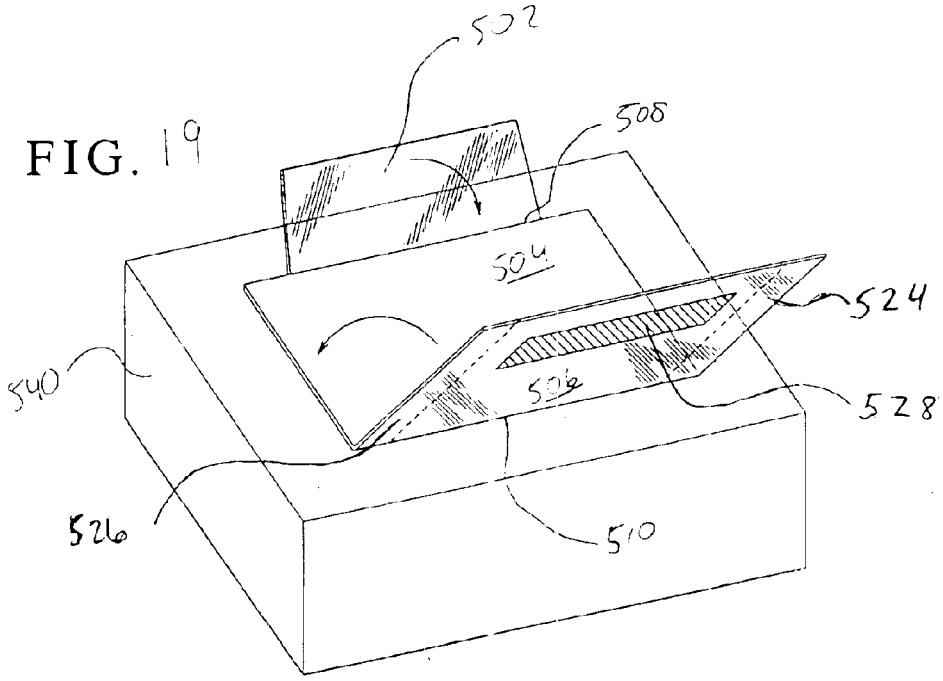
FIG. 19 illustrates a perspective view of a backing sheet adhered to a mailpiece and folded to form an envelope of the present invention.
Figure 20:
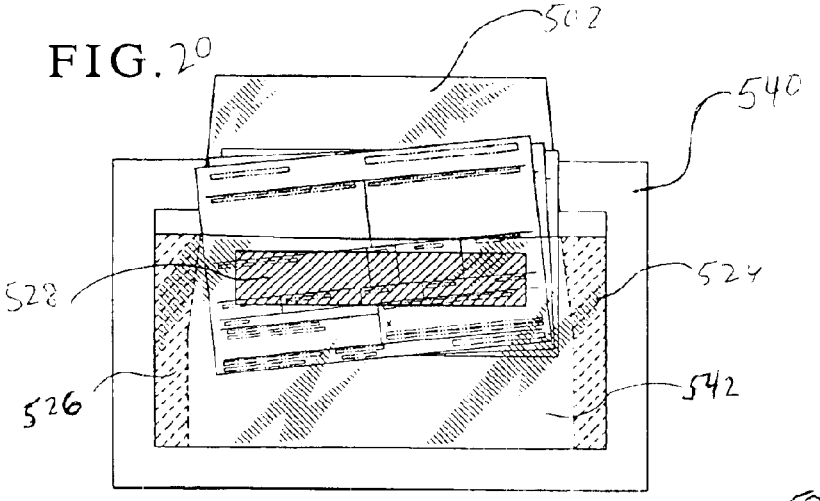
FIG. 20 illustrates a perspective view of a backing sheet adhered to a mailpiece having mailing forms inserted therein.

The third layer 530 may be removed from the backside of the backing sheet 500 to expose the adhesive sections 505,528 contained on the backside of the backing sheet 500. As shown in FIG. 19, the backside of the second section 504 containing the adhesive 505 may be laid flat upon a mailpiece 540 thereby adhering the backing sheet 500 to the mailpiece 540. The third section 506 may then be folded along the fold line 510 and the anchor portions 524,526 may overlay the frontside of the second section 504 thereby adhering the third section 506 to the second section 504 via the adhesive 527.

Figure 21:
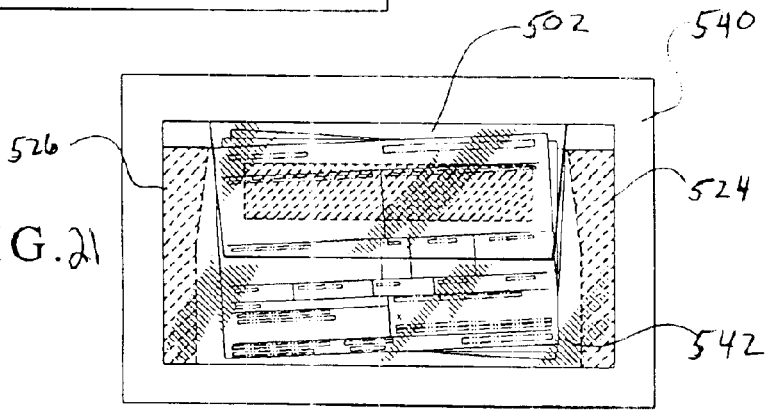
FIG. 21 illustrates a perspective view of an envelope formed from a backing sheet in an embodiment of the present invention.

A compartment 542 may be formed when the third section 506 is overlaid on the second section 504. The two customs declaration forms 302*a*,302*ba* and the dispatch notice may be inserted into the compartment 542. The first section 502 may then fold via the fold line 508 to overlay on the third section 506 thereby being sealed by the adhesive section 528, as shown in FIG. 21, thereby sealing the compartment 542 with the customs declaration forms 302*a*,302*b* and the dispatch notice 304 therein.

FIG. 22 shows an embodiment of a backing sheet 550 having three sections 552, 554 and 556 that may be disposed adjacently and may be separated by foldlines 558 and 560. The backing sheet 550 may contain two side portions 562 and 564 that may run along edges of the backing sheet 550. The side portions 562,564 may contain removable sections 566*a*, 566*b*, respectively, and removable sections 568*a*, 568*b*, respectively. The removable sections 566*a*, 566*b* may be removable from a remainder of the backing sheet 550 via the tear lines 565*a*, 565*b* and 567*a*, 567*b*, respectively. Further, the removable sections 568*a*,568*b* may be removable from a remainder of the backing sheet 550 via tear lines 565*a*, 565*b*, respectively, and tear lines 569*a*, 569*b*, respectively. Adhesive portions 570*a*,570*b* may be contained within the side portions 562,564, respectively.

The first section 552 may contain an adhesive layer 572 disposed on an end of the first section 552. The adhesive layer 572 may be a non-permanent adhesive that may provide an adhering means that may be readily removed from the object to which it is adhered. The second section 554 may contain an adhesive layer 555 of a more permanent nature.

FIGS. 23–25 illustrate how the backing sheet 550 is to be folded and adhered to a mailpiece 574 to create an envelope having a compartment for the customs forms 302*a*,302*b* and 304. The removable sections 566*a*,566*b*, 568*a*,568*b*, may be removed, and the second section 554 containing the adhesive may be placed face-down on the mailpiece 574 to adhere the backing sheet 550 to the mailpiece 574. The adhesive side sections 570*a*,570*b* may be folded to overlay with a portion of the second section 554 and a small portion of the first section 552 thereby exposing the adhesive so that the adhesive faces up. The first section 552 may then be folded along fold line 558 so that the first section 552 overlays the second section 554 thereby adhering to the exposed adhesive on the adhesive side sections 570*a*,570*b*.

A compartment 576 may then be formed between the overlaid first section 552 and the second section 554. The two custom declaration forms 302*a*,302*b* and the dispatch notice 304 may then be inserted into the compartment 576 as shown in FIG. 24. The third section 556 may then be folded along the fold line 560 to overlay on the adhesive section 572 thereby creating a completely sealed compartment 576. The third section 556 may be unfolded along the fold line 560 thereby exposing an entry into the compartment 576 to gain access to the customs forms 302*a*, 302*b* and 304 contained therein while the mailpiece is non-domestically delivered.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A mailing assembly for use in connection with a non-domestic delivery of a mailpiece holding contents for delivery thereof, the assembly comprising:

a backing sheet having a first section and a second section with an adhesive wherein the backing sheet forms a compartment having an interior space formed by attaching the second section to the first section with the adhesive and further wherein the adhesive attaches the compartment to the mailpiece;

a mailing form having a mailing label and a receipt card wherein the mailing label is removably attached to the backing sheet by an adhesive and further wherein the mailing form is variably printed with information necessary to comply with requirements for delivery of the mailpiece wherein the mailing form is inserted into the interior space of the compartment to effect non-domestic delivery of the mailpiece and further wherein the receipt card has no adhesive backing and wherein the receipt card is removably attached to the backing sheet and is detachably connected to the mailing label.

2. The mailing assembly of claim 1 further comprising:

an adhesive layer on the backing sheet.

3. The mailing assembly of claim 1 wherein the compartment formed from the backing sheet is transparent.

4. The mailing assembly of claim 1 further comprising:

an opening in the compartment wherein the mailing form is capable of entering therethrough.

5. The mailing assembly of claim 1 further comprising:

a third layer disposed on the backing sheet having an auxiliary label and further wherein the auxiliary label has an adhesive thereon.

6. The mailing assembly of claim 2 wherein the adhesive layer is between the mailing form and the backing sheet.

7. The mailing assembly of claim 2 wherein the compartment formed from the backing sheet is capable of adhering to the mailpiece via the adhesive layer.

8. The mailing assembly of claim 2 wherein the compartment formed from the backing sheet is capable of being formed via the adhesive layer.

9. A mailing assembly for use in connection with non-domestic delivery of a mailpiece, the assembly comprising:

a backing sheet wherein the backing sheet forms an envelope having a compartment wherein the envelope is adhered to the mailpiece; and a mailing form attached to the backing sheet wherein the mailing form is subdivided into a plurality of sub-parts wherein each sub-part is variably printed with information necessary to comply with requirements for non-domestic delivery of the mailpiece and further wherein at least one of the plurality of sub-parts is inserted into the compartment.

10. The mailing assembly of claim 9 further comprising:

an adhesive layer disposed on the backing sheet.

11. The mailing assembly of claim 9 wherein one of the plurality of sub-parts corresponds to a customs dispatch notice.

12. The mailing assembly of claim 9 further comprising:

tear lines in the mailing form disposed between the plurality of sub-parts.

13. The mailing assembly of claim 9, further comprising:

an adhesive capable of affixing one of the plurality of sub-parts to the backing sheet.

14. The mailing assembly of claim 9 wherein the envelope formed from the backing sheet is transparent.

15. The mailing assembly of claim 10 wherein the envelope formed from the backing sheet is adhered to the mailpiece via the adhesive layer.

16. The mailing assembly of claim 10 wherein the envelope formed from the backing sheet is formed via the adhesive layer on the backing sheet.

17. A mailing assembly for use in connection with non-domestic delivery of a mailpiece, the assembly comprising:

a backing sheet wherein the backing sheet forms an envelope having a compartment wherein the backing sheet is adhered to the mailpiece;

a mailing form removably attached to the backing sheet wherein the mailing form is subdivided into a plurality of sub-parts wherein each sub-part is variably printed with information necessary to comply with requirements for non-domestic delivery of the mailpiece wherein at least one of the plurality of sub-parts is inserted into the compartment; and an adhesive layer disposed on the backing sheet wherein the envelope formed from the backing sheet is formed via the adhesive layer on the backing sheet.

18. A mailing assembly for use in connection with a non-domestic delivery of a mailpiece holding contents for delivery thereof, the assembly comprising:

a backing sheet wherein the backing sheet forms a compartment to be adhered to the mailpiece;

a mailing form having a mailing label and a receipt card wherein the mailing label is removably attached to the backing sheet by an adhesive wherein the mailing form and the mailing label are separate and distinct substrates wherein the mailing form and the mailing label are detachably connected to the receipt card and further wherein the mailing form is variably printed with information necessary to comply with requirements for delivery of the mailpiece wherein the mailing form is inserted into the compartment to effect non-domestic delivery of the mailpiece and further wherein the receipt card has no adhesive backing and wherein the receipt card is removably attached to the backing sheet and is detachably connected to the mailing label; and a third layer disposed on the backing sheet having an auxiliary label and further wherein the auxiliary label has an adhesive thereon.

* * * * *